United States Patent [19]

Lobach

[11] 4,047,030

[45] Sept. 6, 1977

[54] ARRANGEMENT FOR THE MASS-SPECTROMETRIC DETECTION OF IONS

[75] Inventor: Ernst Lobach, Triesenberg, Liechtenstein

[73] Assignee: Balzers Patent-und Beteiligungs-Aktiengesellschaft, Liechtenstein

[21] Appl. No.: 616,267

[22] Filed: Sept. 24, 1975

[30] Foreign Application Priority Data

Sept. 30, 1974 Switzerland ..... 13139/74

[51] Int. Cl.[2] ..... H01J 39/34

[52] U.S. Cl. ..... 250/281; 250/423 R

[58] Field of Search ..... 250/309, 307, 306, 305, 250/281, 282, 283, 423, 424

[56] References Cited

U.S. PATENT DOCUMENTS 3,859,226 1/1975 Schillalies ..... 250/309

*Primary Examiner*—Craig E. Church

*Attorney, Agent, or Firm*—McGlew and Tuttle

[57] ABSTRACT

The arrangement is for the mass-spectrometric detection of ions in the presence of a disturbing background, and is of the type including a source of ions, a mass-spectrometric separating system, a detector for the presence of ions, and a focusing device for the ions interposed between the source and the detector. The focusing device comprises an asymmetric electrostatic focusing lens arrangement having semi-cylindrical electrodes defining a lens axis, an ion entrance aperture, and an ion exit aperture. In three embodiments of the electrostatic focusing lens, the ion entrance aperture is eccentric to the axis of the lens. In a fourth embodiment, the ion entrance and exit apertures are coaxial with the lens axis and a pair of intermediate electrodes define an ion aperture which is eccentric relative to the axis of the lens.

7 Claims, 5 Drawing Figures

ARRANGEMENT FOR THE MASS-SPECTROMETRIC DETECTION OF IONS

FIELD AND BACKGROUND OF THE INVENTION

The present invention relates to an arrangement for the mass-spectrometric detection of ions in the presence of a disturbing background.

In ion detection arrangements, disturbances are caused by foreign particles, intruding into the entrance area of a mass spectrometer, from radiation sources such as ionization gauges, electron-beam heating devices, hot cathodes, or the like. For example, in secondary-ion mass spectrometry, a target is bombarded with primary ions and the secondary ions knocked off by the bombardment are mass-spectrometically analyzed. At the same time, in addition to the secondary ions to be detected, reflected primary ions, high-energy secondary electrons and ions, photons and neutral particles appear as disturbing particles. The neutral particles are disturbing because they may produce again, in secondary processes, charged particles to which the detector is responsive.

To eliminate the disturbing background, various arrangements have already been designed comprising a mass-spectrometric separating system and a detector for determining the presence of ions and in which, along the path of the ions from the source of the detector, means are provided for producing electric or magnetic fields serving to sort out the undesirable particles (RSI, Vol. 44, No. 4, April 1973, pp. 487 to 491).

For example, in a known device (German Offenlegunsschrift No. 2,255,302), a mask interrupting the sight path is mounted between the sample delivering ions and the entrance plane of the mass analyzer, preventing the disturbing particles from passing directly into and through the mass analyzer. In this case, the electrostatic lens must be designed so that a part of the ions to be detected flows past the mask. However, another part of the ions cannot be prevented from being intercepted by the mask and thus is lost for the analysis. Further, the useful ions leave the lens arrangement under a too large inclination relative to the axis of the lens, which is unfavorable for the mass-spectrometric analysis.

In another known arrangement (International Journal of Mass Spectrometry and Ion Physics, 11, (1973) 23–35), a plate capacitor is used for producing an electric deflection field deflecting the useful ions into the mass spectrometer and preventing the disturbing particles from passing thereinto. This arrangement, however, has no direction focusing effect (collecting effect) on the useful ions, so that the desired signal is needlessly weakened.

In a further known arrangement, electrons which are particularly disturbing in the detection of negative ions are separated by means of a magnetic deflection field, whereby a signal-to-background ratio is obtained which is almost equally satisfactory to that obtained hitherto only in the detection of positive ions (German Utility Model No. 73 37645).

SUMMARY OF THE INVENTION

The present invention is directed to a further improvement of the signal-to-background ratio in the detection both of positive ions and negative ions.

In accordance with the invention, an arrangement for the mass-spectrometric detection of ions is provided, comprising a mass-spectrometric separating system, a focusing device for the ions, and a detector for determining the presence of the ions, and in which an asymmetric electrostatic lens is used as the focusing device.

For the purpose of this spectification, those electrostatic lenses are understood to be asymmetric which, in addition to the known focusing property, permit a deflection of the focus perpendicularly to the axis of the lens.

As compared with the known arrangement comprising a symmetric electrostatic lens within which, on the axis thereof, a mask interrupting the course of the beam is mounted, the invention ensures that the ion beam entering the lens can pass therethrough less weakened and that, in spite of that, the passage of disturbing particles is largely suppressed.

An object of the invention is to provide an improved arrangement for the mass-spectrometric detection of ions in the presence of a disturbing background.

Another object of the invention is to provide such an arrangement resulting in an improvement of the signal-to-background ratio in the detection both of positive ions and negative ions.

A further object of the invention is to provide such an arrangement in which an asymmetric electrostatic lens is used as a focusing device.

For an understanding of the principles of the invention, reference is made to the following description of typical embodiments thereof as illustrated in the accompanying drawings.

BRIEF DESCRIPTION OF THE DRAWINGS

In the Drawings:

FIG. 1*b* is a diametric sectional view taken on the line *b—b* of FIG. 1*a.

DESCRIPTION OF THE PREFERRED EMBODIMENTS

The drawings illustrate several electrode systems which may be mounted in mass-spectrometric arrangements, as ion filters, and embodying the invention. It will be readily understood by one having even ordinary skill in the art that, in such a case, there are available a plurality of possibilities for the mechanical construction of the illustrated systems of electrodes. Consequently, illustration of electrode holders, insulating supports, voltage leads, etc., have been omitted.

Figure 1A:
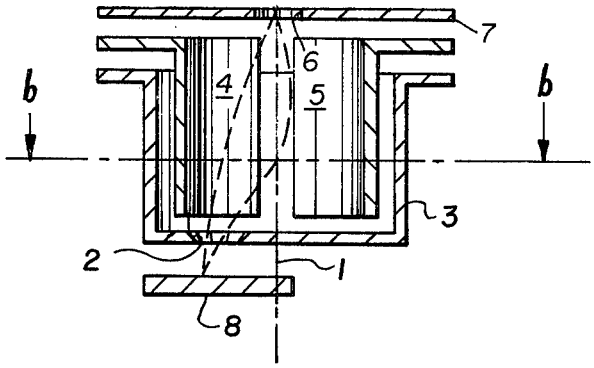
FIG. 1*a* is an axial sectional view through an asymmetric focusing lens embodying the invention.
Figure 1B:
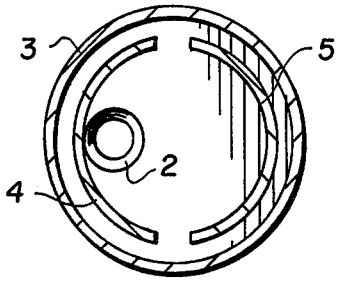

Referring to the drawings, FIGS. 1a and 1b show a first embodiment of an asymmetric electrostatic lens system, in accordance with the invention, comprising a first electrode 3 which is provided with an ion entrance aperture 2 located off the axis, or eccentrically, of the lens arrangement, a pair of semicylindrical electrodes 4 and 5, and a further electrode 7 which is provided with an exit aperture 6 for the ions to be detected. The mutual arrangement of the electrodes is evident from FIG. 1*a*, and FIG. 1*b* is a sectional view taken perpendicularly to the drawing plane of FIG. 1*a*.

The illustrated electrode arrangement may be used as an ion filter preferably permitting the passage of the ions to be detected (thus useful ions) while preventing the greatest part of the particles not to be detected, and causing the disturbing background, from leaving the lens again, and mounted, either between the source of the ions to be examined, for example, a target 8 bombarded with primary ions, and the entrance aperture of a mass-spectrometric separating arrangement, or between the exit aperture of this arrangement and a detector. In the first case, only disturbing particles which might issue from the source are prevented from entering the mass-spectrometric separating arrangement while, in the second case, even disturbing particles which are only the result of secondary processes in the mass spectrometer are largely suppressed and do not pass into the detector.

The potentials of the electrodes of FIG. 1 are to be chosen, in a manner well-known in electrostatic focusing lenses, so as to obtain a cross-over (focus), for the ions to be detected, in the plane of the exit aperture. At the same time, different potentials are applied to the two semicylindrical electrodes, the difference being such that, in spite of the eccentric location of the entrance aperture 2 relative to the axis of the lens, the crossover or focus comes to lie in the exit aperture 6 which is located on the axis. It is particularly advantageous if the two electrodes 3 and 7 are placed at ground potential, while a mean DC potential, corresponding to the sign of charge of the ions to be focused, is applied to the semicylindrical electrodes 4 and 5, having a value such that the desired focusing is obtained and, in addition, an appropriate deflection potential is superposed. For example, with an electrode system, according to FIG. 1, and with a potential of 95 volts at the first semicylindrical electrode 4, a potential of 175 volts at the second semicylindrical electrode 5 and a potential of 100 volts at a molybdenum target 8 bombarded with argon ions of 0.3 to 3 kV, a more than hundredfold improvement of the signal-to-background ration has been obtained.

Figure 2:
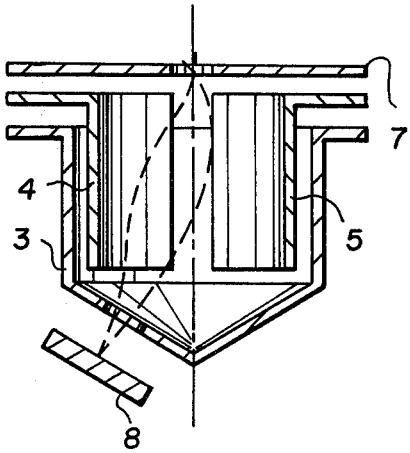
* and FIGS. 2, 3 and 4 are views, similar to FIG. 1*a*, of further embodiments of the invention.

The arrangement of FIG. 1 can be advantageously used in devices where the axis of the particle beam to be filtered extends parallel to the axis of the lens arrangement, in which case, however, the emerging beam has a certain (very small) inclination to the axis of the lens. In some applications, this is desirable. The arrangement of FIG. 2, on the contrary, ensures an emerging beam with an axis coinciding with the axis 1 of the lens arrangement. However, the entering beam is inclined relative to the axis of the lens.

Figure 3:
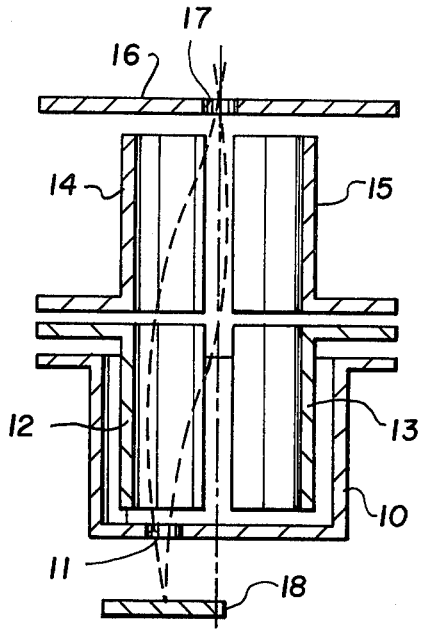

Compared with this, the tandem arrangement of two lenses, according to FIG. 3, offers the advantage that the axes both of the entering and of the leaving particle beam can extend parallel to the axis of the lenses. The arrangement shown in FIG. 3 comprises an electrode 10, having an entrance aperture 11 eccentric to the lens axis, for the particle beam to be filtered, a first pair of semicylindrical focusing and deflecting electrodes 12 and 13, a second pair of such electrodes 14 and 15, and an electrode 16 provided with an exit port 17 for the particles to be permitted to pass through, the operational potentials of the mentioned electrodes being again chosen so that the ions to be detected and issuing from a target 18 are focused, due to the focusing and deflecting effect of the two asymmetric lenses embodying the illustrated electrode system, just into the exit port and, therefore, may pass, without notable weakening, into the mass-spectrometric separating system or the following detector, while the greatest part of the other particles (be it photons, uncharged neutral particles, or charged particles with another specific charge) is prevented from passing through the system.

In this arrangement, (which substantially is a combination of two electrode systems according to FIG. 1), the same potential can be applied to electrodes 13 and 14, so that they may be electrically connected to each other. The same applies to the two electrodes 12 and 15.

Figure 4:
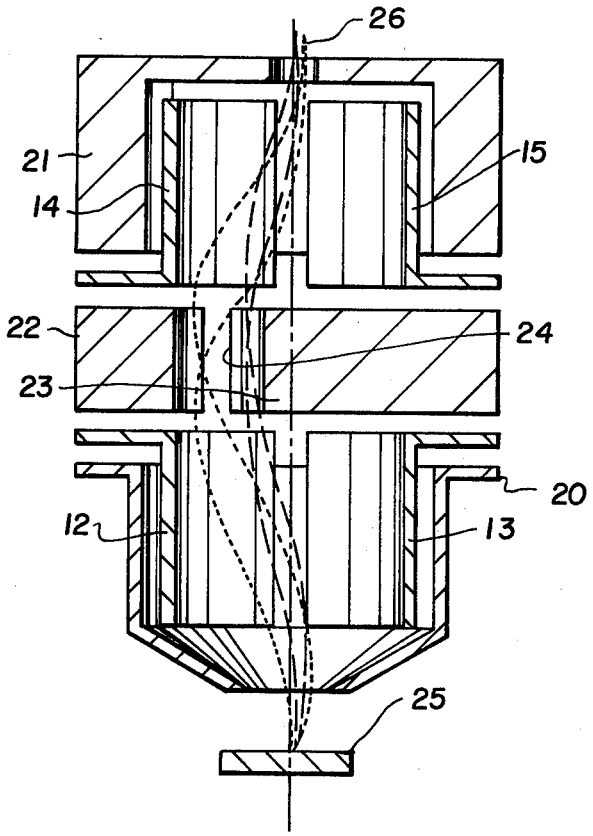

Another embodiment, shown in FIG. 4, comprises three pairs of electrodes for deflecting the ions in a direction perpendicular to the axis of the arrangement. This system may be construed as a combination of two systems of FIG. 3 in which the two interior deflection electrode pairs 12, 13 and 14, 15 of FIG. 3 are united to a single pair of intermediate electrodes 22 and 23 defining an aperture 24 eccentric to the lens axis. As compared to the simpler systems shown in FIGS. 1, 2 and 3, the system according to FIG. 4 offers the advantage of a double focusing, i.e., that all ions with the same location of origin on the target 25 and belonging to a predetermined energy range to be detected are focused into the exit port 26. The energy discrimination effected in the lower part 20 of the lens system is compensated by the upper part 21.

At the same time, the fact that the sight path, between the entrance and the exit ports of the whole system, is interrupted, results in the advantage that a better separation of neutral particles is also obtained, as these no longer can pass through the device directly.

In all figures, the path of the focused beam of ions is indicated in broken lines. In FIG. 4, two beams are indicated for ions having different initial energies.

While specific embodiments of the invention have been shown and described in detail to illustrate the application of the principles of the invention, it will be understood that the invention may be embodied otherwise without departing from such principles.

What is claimed is:

1. In an arrangement for the mass-spectrometric detection of ions, in the presence of a disturbing background, of the type including a source of ions, a mass-spectrometric separating system, a detector for the presence of ions, and a focusing device for the ions interposed between the source and the detector, an improved focusing device comprising an asymmetric electrostatic focusing lens system having a lens axis, an ion entrance aperture, and an ion exit aperture, and having at least a portion thereof assymetric to at least one of said apertures; said assymetric electrostatic focusing lens system suppressing the passage of disturbing particles while providing substantially unrestricted passage of ions between said entrance and exit apertures.

2. An arrangement as claimed in claim 1, in which said lens system comprises focusing electrodes and at least one pair of electrodes deflecting the ion beam perpendicular to said lens axis.

3. An arrangement as claimed in claim 1, in which said asymmetric electrostatic lens comprises a first electrode formed with said ion entrance aperture eccentric to said lens axis, a pair of semi-cylindrical deflecting and focusing electrodes, and a further electrode formed with said ion exit aperture for the ions to be detected.

4. An arrangement as claimed in claim 1, in which said electrostatic lens system comprises at least two pairs of ion deflecting electrodes.

5. An arrangement as claimed in claim 1, in which said electrostatic focusing lens system comprises at least two asymmetric lenses mounted in series with each other and so dimensioned that the energy discrimination of the useful ions, effected by the leading lens, is compensated by the following lens.

6. An arrangement as claimed in claim 5, in which each of said asymmetric lenses constituting said lens system comprises a pair of semi-cylindrical deflecting and focusing electrodes interposed between said ion entrance aperture and said ion exit aperture.

7. An arrangement as claimed in claim 2, in which said asymmetric electrostatic focusing lens system comprises two asymmetric lenses interposed between said ion entrance aperture and said ion exit aperture, said ion entrance and exit apertures being coaxial with said lens axis, and a pair of intermediate electrodes interposed between said two pairs of deflecting electrodes and defining an intermediate aperture, for the passage of ions, which is eccentric to said lens axis.

* * * * *